US010755664B2

(12) United States Patent
Kim et al.

(10) Patent No.: US 10,755,664 B2
(45) Date of Patent: Aug. 25, 2020

(54) DISPLAY DEVICE HAVING A CURRENT CONTROLLER FOR REDUCING INRUSH CURRENTS AND METHOD OF DRIVING THE SAME

(71) Applicant: LG DISPLAY CO., LTD., Seoul (KR)

(72) Inventors: Kwang-Min Kim, Paju-si (KR); Yeong-seok Choe, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/206,256

(22) Filed: Nov. 30, 2018

(65) Prior Publication Data

US 2019/0197981 A1 Jun. 27, 2019

(30) Foreign Application Priority Data

Dec. 27, 2017 (KR) ..... 10-2017-0180936

(51) Int. Cl.
*G09G 3/36* (2006.01)

(52) U.S. Cl.
CPC ..... *G09G 3/3688* (2013.01); *G09G 2330/025* (2013.01); *G09G 2330/06* (2013.01)

(58) Field of Classification Search
CPC ..... G09G 3/3688
USPC ..... 345/212
See application file for complete search history.

(56) References Cited

U.S. PATENT DOCUMENTS

2014/0176617 A1* 6/2014 Jeong ..... G09G 3/2003 345/690
2014/0313183 A1* 10/2014 Harada ..... G09G 3/3611 345/212
2017/0084227 A1* 3/2017 Bae ..... G09G 3/3275

* cited by examiner

*Primary Examiner* — Long D Pham
(74) *Attorney, Agent, or Firm* — Birch, Stewart, Kolasch & Birch, LLP

(57) ABSTRACT

A display device and method of driving the same are provided. The display device includes a data modulator generating image data from an image signal provided from an outside, a data driver generating and outputting a data signal according to the image data, and a display panel displaying an image by using the data signal, wherein the data modulator comprises a current controller including a plurality of switching elements connected in parallel.

12 Claims, 6 Drawing Sheets

DISPLAY DEVICE HAVING A CURRENT CONTROLLER FOR REDUCING INRUSH CURRENTS AND METHOD OF DRIVING THE SAME

CROSS-REFERENCE TO RELATED APPLICATIONS

This application claims the priority benefit under 35 U.S.C. § 119(a) to Korean Patent Application No. 10-2017-0180936, filed on Dec. 27, 2017, in the Korean Intellectual Property Office, which is incorporated herein by reference in its entirety.

BACKGROUND

1. Technical Field

The present disclosure relates to a display device and a method of driving the same, and more particularly, to a display device capable of reducing inrush currents and a method of driving the same.

2. Discussion of the Related Art

Recently, with entering into a full-fledged information age, the field of displays which process and display mass information has been rapidly developed. For instance, a variety of flat panel displays (FPDs) have been developed and spotlighted. As examples of FPDs, there are liquid crystal display (LCD) devices, plasma display panel (PDP) devices, organic light emitting diode (OLED) devices, and the like.

A display device displays an image by adjusting a light emitting rate, light transmittance, or the like of each pixel through a plurality of pixels arranged on a display panel of the display device.

To do this, each of the image display devices includes a display panel in which pixels are arranged in a matrix shape and includes a driving circuit for driving the display panel.

Here, the driving circuit of the display device includes a plurality of data integrated circuits supplying image signals to a plurality of data lines which are image signal supply lines of the display panel, and further includes a plurality of gate integrated circuits scanning pixels for each line to display image signals on the pixels.

Each of the data integrated circuits converts digital image data supplied for at least one horizontal line into analog image signals and supplies the analog image signals for at least one horizontal line to the plurality of data lines.

The data integrated circuits drive the plurality of data lines for at least one horizontal line at the same time through a plurality of output channels.

As described above, when image signals are output to the output channels of the data integrated circuits at the same time, interferences can occur between adjacent signals. Also, when an output current level arrives at a peak value, the data integrated circuits can malfunction, or output current waves can occur such that a variety of problems such as degradation of display quality of images and the like occur.

Particularly, inrush currents, which are over currents and instantaneously occur by operation currents input to a data modulator at the same time during driving, are generated, and thus electromagnetic interference (EMI) noise of a broadband can increase.

SUMMARY

Embodiments are directed to a display device that substantially obviates one or more of the problems due to limitations and disadvantages of the related art.

It is an object of the present disclosure to provide a display device and a method of driving the same capable of reducing inrush currents by including a current controller including a plurality of switching elements connected in parallel.

According to an aspect of the present disclosure, there is provided a display device including a data modulator generating image data from an image signal provided from an outside, a data driver generating and outputting a data signal according to the image data, and a display panel displaying an image by using the data signal, wherein the data modulator comprises a current controller including a plurality of switching elements connected in parallel.

Another aspect, a method of driving a display device includes generating image data from an image signal provided from an outside by a data modulator including a current controller and a current sensor, and generating a data signal according to the image data by a data driver.

Advantages and features of the disclosure will be set forth in part in the description which follows and in part will become apparent to those having ordinary skill in the art upon examination of the following or can be learned from practice of the disclosure. Other advantages and features of the embodiments herein can be realized and attained by the structure particularly pointed out in the written description and claims hereof as well as the appended drawings.

It is to be understood that both the foregoing general description and the following detailed description are explanatory, and are intended to provide further explanation of the embodiments as claimed.

BRIEF DESCRIPTION OF THE DRAWINGS

The accompanying drawings, which are included to provide a further understanding of the disclosure, are incorporated in and constitute a part of this specification, illustrate implementations of the disclosure and together with the description serve to explain the principles of embodiments of the disclosure.

DETAILED DESCRIPTION OF THE EMBODIMENTS

Hereinafter, embodiments of the present disclosure will be described with reference to the drawings.

The embodiments of the present disclosure can be applied to any type of a display device. However, hereinafter, for convenience of description, a liquid crystal display will be described as an example of a display device.

Figure 1:
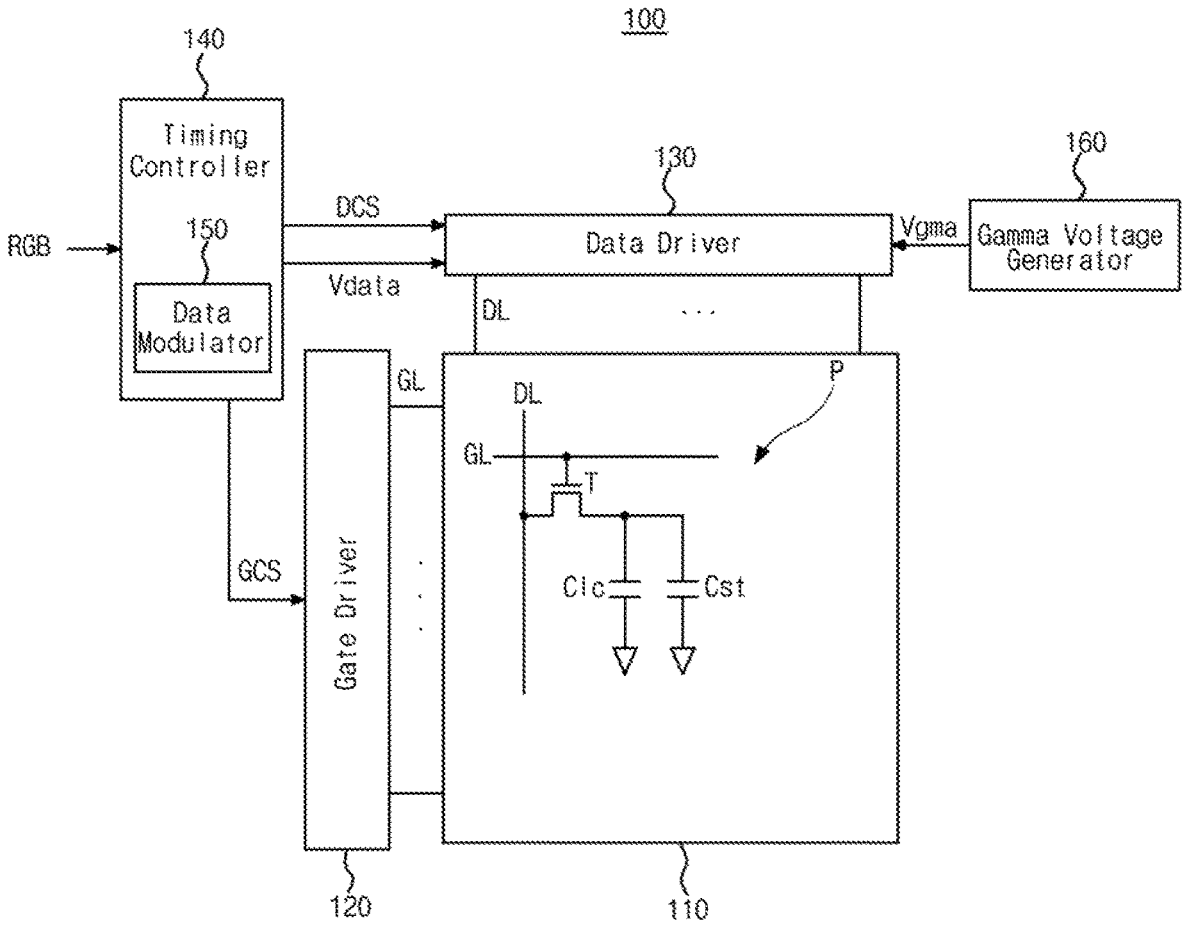
FIG. 1 is a schematic view illustrating a display device according to an embodiment of the present disclosure.

FIG. 1 is a schematic view illustrating a display device according to the embodiment of the present disclosure. All the components of the display device according to all embodiments of the present disclosure are operatively coupled and configured.

As shown in FIG. 1, a display device 100 can include a display panel 110 which displays an image and a driving circuit which drives the display panel 110.

For example, the driving circuit can include a timing controller 140, a gate driver 120, a data driver 130, a gamma voltage generator 160, and the like.

Also, the display panel 110 can include a liquid crystal layer interposed between an array substrate and a color filter substrate.

Here, a plurality of gate lines GL and a plurality of data lines DL are formed on the array substrate of the display panel 110 to cross each other such that a plurality of pixel regions can be defined.

Also, in each of the pixel regions, a pixel P which includes a thin film transistor (TFT) T, a liquid crystal capacitor Clc, and a storage capacitor Cst can be formed.

A black matrix, a color filter, and a common electrode can be formed on the color filter substrate of the display panel 110.

Alternatively, the common electrode can be formed on the array substrate depending on an operation type of the display panel 110.

Here, in the display panel 110, the thin film transistor T of the pixel P is turned on according to gate signals applied through the plurality of gate lines GL, and data signals applied through the plurality of data lines DL are supplied to a pixel electrode by the turned-on thin film transistor T.

Also, the liquid crystal capacitor Clc of the pixel P charges a voltage according to a difference between the data signal supplied to the pixel electrode and a common voltage supplied to the common electrode and adjusts light transmittance of a liquid crystal layer according to the charged voltage such that the display panel 110 displays a desired image.

The storage capacitor Cst of the pixel P can maintain the voltage charged in the liquid crystal capacitor Clc until a next data signal is supplied.

Also, the timing controller 140 can generate a control signal for controlling operations of the gate driver 120 and the data driver 130 by using a control signal input from an external system, for example, a timing signal such as a data enable DE, a dot clock DCLK, a vertical synchronous signal Vsync, a horizontal synchronous signal Hsync, and the like.

Here, the control signals generated by the timing controller 140 can include a gate control signal GCS and a data control signal DCS.

The gate control signal GCS includes a gate start pulse GSP, a gate shift clock GSC, a gate output enable GOE, and the like. The data control signal DCS can include a source start pulse SSP, a source sampling clock SSC, a source output enable SOE, and a polarity control signal POL.

Also, the timing controller 140 can include a data modulator 150 which generates image data Vdata by modulating an image signal RGB input from an external system.

The data modulator 150 can generate image data Vdata by modulating grayscales of image signals RGB to increase or decrease corresponding to the pixels P connected to some particular horizontal lines, for example, the plurality of gate lines GL for each frame of the display panel, for example, each of an odd frame and an even frame.

Also, the data modulator 150 can determine a frame and a horizontal line of the display panel 110 on which an image signal RGB is displayed and can modulate a grayscale of an image signal RGB corresponding to a particular horizontal line of each frame with reference to the determined result.

Also, the data modulator 150 can convert an input image signal RGB into red, green, blue and white image data Vdata and can output the same.

The gate driver 120 can generate a gate signal according to a gate control signal GCS output by the timing controller 140. Here, gate signals can be sequentially output to the plurality of gate lines GL of the display panel 110.

The gate driver 120 can be formed as a chip on film (COF) to be attached to one side of the display panel 110 or can be formed as a gate in panel (GIP) to be included in one side of the display panel 110.

The data driver 130 can sample, latch, and convert the image data Vdata output by the data modulator 150 into parallel data according to the data control signal DCS output by the timing controller 140.

Here, the data driver 130 can generate a data signal from the parallel data obtained by being converted using a plurality of gamma voltages Vgma provided by the gamma voltage generator 160.

The data signals can be output through the plurality of data lines DL when the plurality of gate lines GL are enabled by the gate signals.

Meanwhile, the plurality of gamma voltages Vgma can be output from the gamma voltage generator 160 and can include a positive gamma voltage and a negative gamma voltage.

As described above, the gamma voltage generator 160 generates and supplies the gamma voltages Vgma to the data driver 130 such that voltages corresponding to image data Vdata can be generated by using the supplied gamma voltages.

Figure 2:
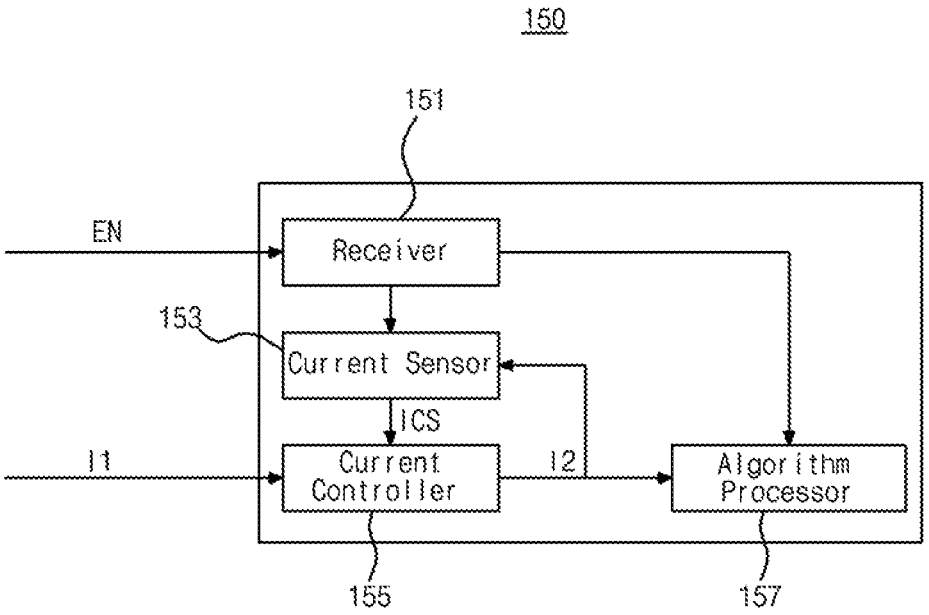
FIG. 2 is a schematic view illustrating a data modulator of the display device according to the embodiment of the present disclosure.

FIG. 2 is a schematic view illustrating an example of the data modulator of the display device according to the embodiment of the present disclosure.

As shown in FIG. 2, the data modulator 150 of the display device 100 of FIG. 1 according to the embodiment of the present disclosure can include a receiver 151, a current sensor 153 (e.g., electric current sensor), a current controller 155 (e.g., electric current controller), and an algorithm processor 157.

The data modulator 150 can be located in the timing controller 140 of FIG. 1 and can receive an enable signal EN from the timing controller 140 of FIG. 1. However, the data modulator 150 is not limited thereto and can be configured separately from the timing controller 140 of FIG. 1.

Also, the receiver 151 of the data modulator 150 can receive an enable signal EN from the outside and can drive the algorithm processor 157 and the current sensor 153 in response to the input enable signal EN.

Further, the data modulator 150 can be synchronized with the enable signal EN and receive a current I1 from the outside. At this time, the current I1 input to the data modulator 150 can pass through the current controller 155 and can be supplied to the algorithm processor 157.

Particularly, the current controller 155 of the present disclosure can include a plurality of switching elements connected in parallel. The plurality of switching elements can be sequentially turned on when the current I1 is applied to the current controller 155 in a turned-off state.

The current I1 input to the current controller 155 can be output through the plurality of switching elements which are sequentially turned on, and a current I2 output from the current controller 155 can be transmitted to the algorithm processor 157.

Here, the current sensor 153 can sense the current I2 output from the current controller 155 in real time and can generate, according to the sensed current I2, and transmit, to the current controller 155, a current control signal ICS capable of allowing the current controller 155 to control the number of switching elements which are turned on.

For example, when the current I2 output by the current controller 155 is reduced in comparison to a preset reference current value, the current sensor 153 can measure the reduced current I2 and can generate and supply a current control signal ICS corresponding thereto to the current controller 155, and the current controller 155 can control the number of the switching elements which are turned on according to the current control signal ICS.

In addition, when the current I2 output by the current controller 155 is increased in comparison to the preset reference current value, the current sensor 153 can measure the increased current I2 and can generate and supply a current control signal ICS corresponding thereto to the current controller 155, and the current controller 155 can control the number of the switching elements which are turned on according to the current control signal ICS.

As described above, in the data modulator 150 of the display device 100 of FIG. 1 according to the embodiment of the present disclosure, since the plurality of switching elements of the current controller 155 which are connected in parallel are sequentially turned on, electromagnetic interference (EMI) noise can be effectively decreased by reducing inrush currents, which instantaneously occur during driving by operation currents input to the data modulator 150 at the same time.

Figure 3A:
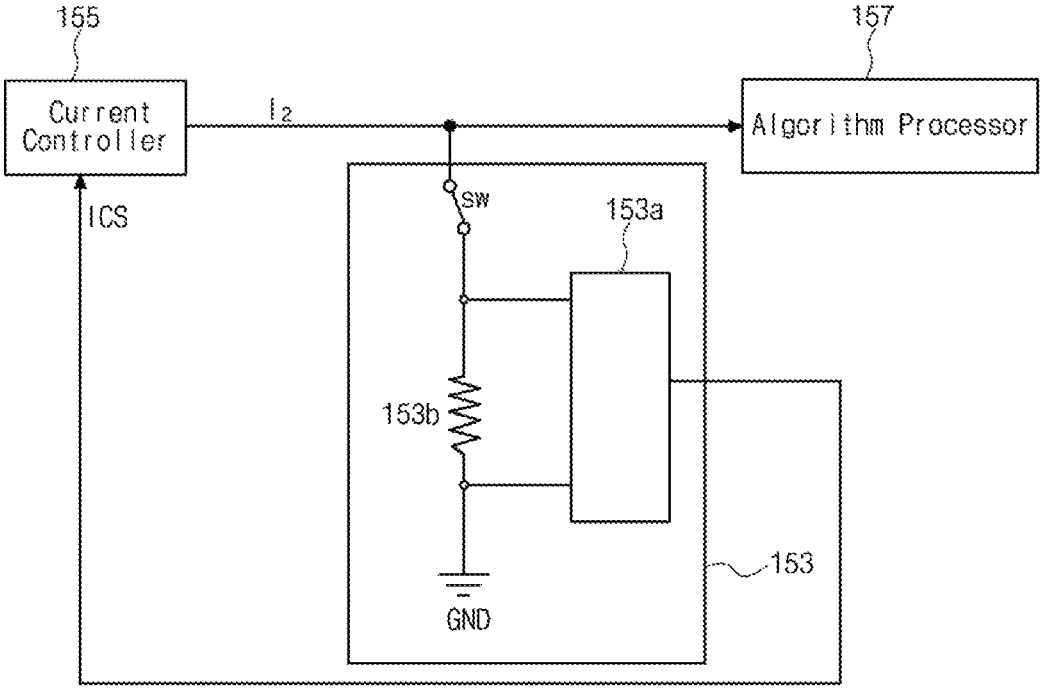
FIGS. 3A and 3B are schematic views illustrating examples of a current sensor of the display device according to the embodiment of the present disclosure.
Figure 3B:
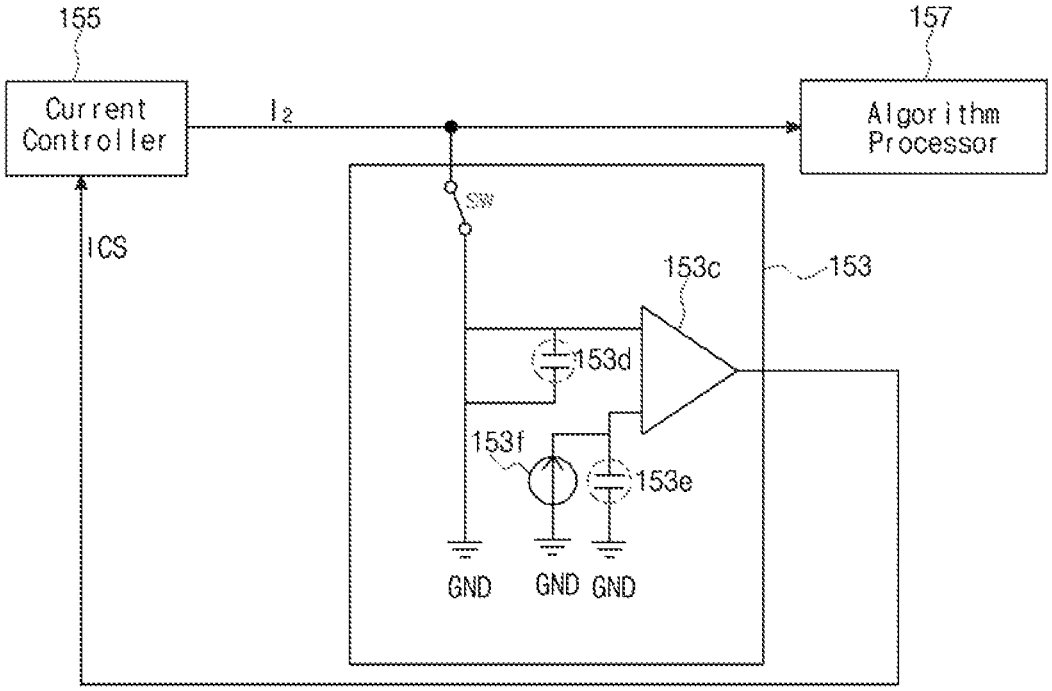

FIGS. 3A and 3B are schematic views illustrating examples of the current sensor of the display device according to the embodiment of the present disclosure.

As shown in FIGS. 3A and 3B, the current sensor 153 senses a current I2 output from the current controller 155 and generates and supplies a current control signal ICS to the current controller 155 by using a detected current value.

Here, the current sensor 153 can sense the current I2 output from the current controller 155 in real time. Further, the current sensor 153 can regularly or irregularly sense the current I2.

As shown in FIG. 3A, the current sensor 153 can include a switching element SW, a resistor 153*b* connected to the switching element SW, and a sensor 153*a* connected to both ends of the resistor 153*b*.

When the switching element SW of the current sensor 153 is turned on, the sensor 153*a* can measure a voltage drop at the resistor 153*b* so as to measure a current I2 output from the current controller 155 and can generate and transmit, to the current controller 155, a current control signal ICS corresponding to a measured current value.

Also, the current sensor 153 can sense an output current I2 and can include a look-up table for generating a current control signal ICS corresponding thereto.

Meanwhile, in another example, the current sensor 153, as shown in FIG. 3B, can include a switching element SW, a first capacitor 153*d* connected to the switching element SW, a current source 153*f*, a second capacitor 153*e* connected to the current source 153*f*, and a comparator 153*c* connected to the first capacitor 153*d* and the second capacitor 153*e*.

The comparator 153*c* can include a first input terminal connected to the first capacitor 153*d*, a second input terminal connected to the second capacitor 153*e*, and an output terminal outputting a current control signal ICS.

The first capacitor 153*d* can be connected between the switching element SW and the first input terminal of the comparator 153*c*. The second capacitor 153*e* can be connected between the second input terminal of the comparator 153*c* and a ground GND. Also, the current source 153*f* can be connected to the second capacitor 153*e* in parallel.

Here, a current applied through the switching element SW can supply charges to the first capacitor 153*d*, and a current applied through the current source 153*f* can supply charges to the second capacitor 153*e*.

Also, the quantity of charges stored in the first capacitor 153*d* can be provided to the first input terminal of the comparator 153*c*, and the quantity of charges stored in the second capacitor 153*e* can be provided to the second input terminal of the comparator 153*c*.

Here, the comparator 153*c* can generate a current control signal ICS according to a result of comparing the quantity of charges stored in the first capacitor 153*d* which are provided to the first input terminal with the quantity of charges stored in the second capacitor 153*e* which are provided to the second input terminal and can transmit the current control signal ICS to the current controller 155 through the output terminal.

Also, the current sensor 153 can sense an output current I2 and can include a look-up table for generating a current control signal ICS corresponding thereto.

Here, the configurations of the current sensor 153 shown in FIGS. 3A and 3B are merely examples, and the present disclosure is not limited thereto and includes other variations.

Figure 4:
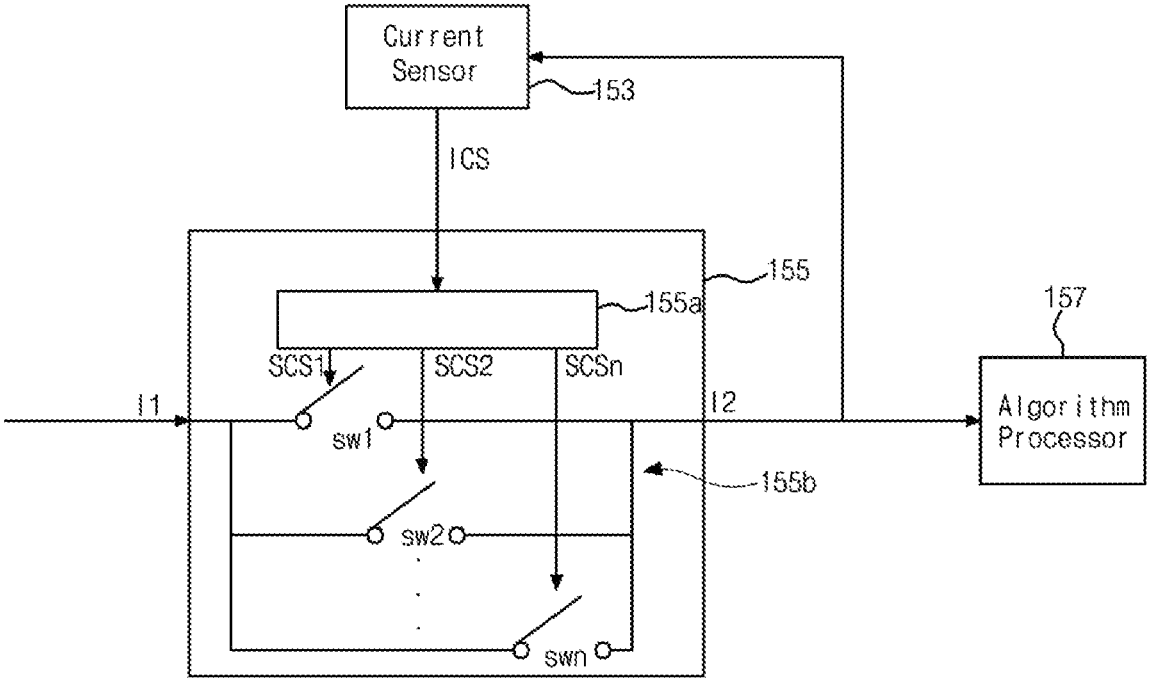
FIG. 4 is a schematic diagram illustrating a current controller of the display device according to the embodiment of the present disclosure.

FIG. 4 is a schematic view illustrating an example of the current controller of the display device according to the embodiment of the present disclosure.

As shown in FIG. 4, the current controller 155 of the display device 100 of FIG. 1 according to the embodiment of the present disclosure can include a switching controller 155*a* and a switching portion 155*b*.

The switching controller 155*a* can receive a current control signal ICS from the current sensor 153 and can control each of switching elements SWn.

That is, the switching controller 155*a* can generate a switching control signal SCS capable of being synchronized with the current control signal ICS and turning each switching element SW on or off so as to control each of the switching elements SWn.

Meanwhile, the switching portion 155*b* can include a plurality of such switching elements SWn connected in parallel.

Particularly, the plurality of switching elements SWn of the current controller 155 of the display device 100 of FIG. 1 according to the embodiment of the present disclosure can operate sequentially. For example, all the plurality of switching elements SWn can be sequentially turned on. Alternatively, some of the plurality of switching elements SWn can be sequentially turned on and others of the plurality of switching elements SWn can be turned off.

Currents I1 input to the current controller 155 can be sequentially dispersed into a plurality of lines by the plurality of switching elements SWn, which are sequentially turned on, and currents I2 can be integrated again and output through one line at an end of the switching portion 155*b*.

Accordingly, inrush currents can be reduced through sequential dispersion of currents in an initial stage of driving and can return to current levels necessary for driving after the initial stage of driving.

Also, each of the plurality of switching elements SWn can be turned on or off by a switching control signal SCSn. For example, a first switching element SW1 can be turned on by a first switching control signal SCS1 from the switching controller 155*a*, and a second switching element SW2 can be sequentially turned on by a second switching element SCS2 from the switching controller 155*a*.

Particularly, each of the plurality of switching elements SWn of the current controller 155 of the display device 100 of FIG. 1 according to the embodiment of the present disclosure can be sequentially turned on.

As described above, the plurality of switching elements SWn connected in parallel are sequentially turned on, and inrush currents, which instantaneously occur in the initial stage of driving due to operation currents input to the data modulator 150 of FIG. 2 at the same time, can be reduced such that EMI noise can be effectively reduced.

Figure 5:
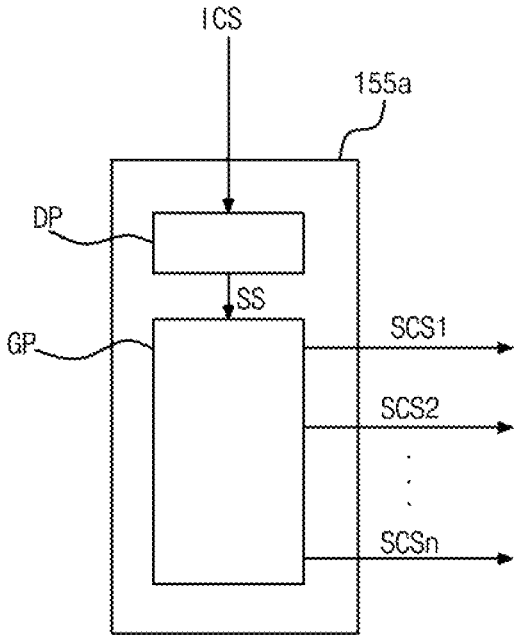
FIG. 5 is a schematic view illustrating a switching controller of the current controller of the present disclosure.

FIG. 5 is a schematic view illustrating an example of the switching controller of the current controller of the present disclosure.

As shown in FIG. 5, the switching controller 155*a* can include a decoder DP and a switching control signal generator GP.

The decoder DP can decode a current control signal ICS input from the current sensor 153 of FIG. 4 so as to supply a selection signal SS internally corresponding to a decoding result to the switching control signal generator GP.

Also, the switching control signal generator GP can generate a switching control signal SCSn corresponding to the selection signal SS supplied from the decoder DP and can supply the switching control signal SCSn to the switching portion 155*b* of FIG. 4 so as to turn on at least one of the plurality of switching elements SWn of FIG. 4 of the switching portion 155*b* of FIG. 4.

Figure 6A:
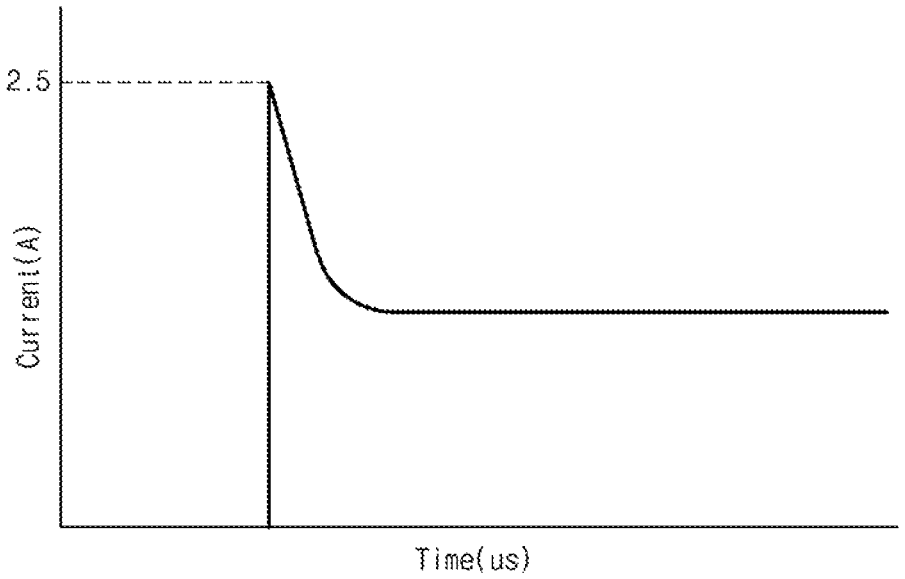
FIG. 6A is a graph schematically illustrating an example of inrush currents which can occur while a conventional display device is driven.
Figure 6B:
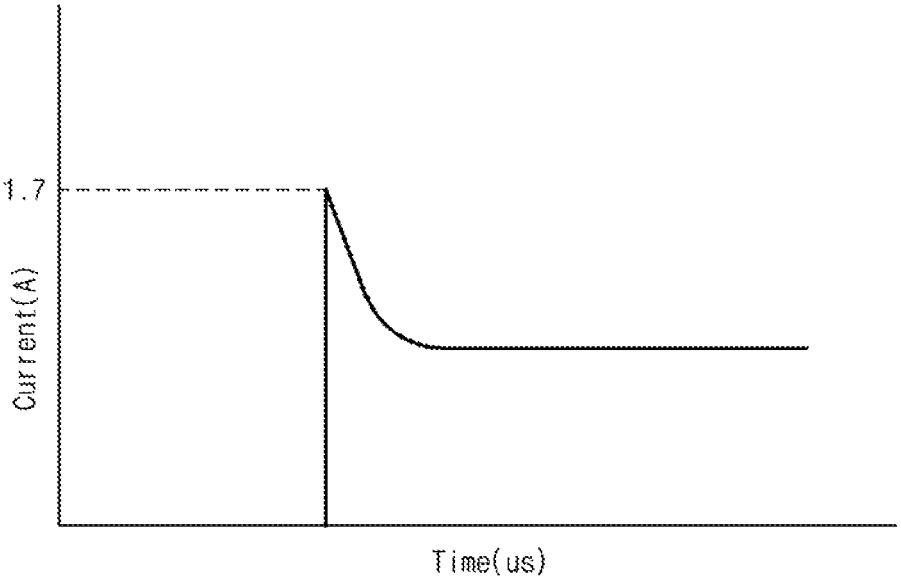
FIG. 6B is a graph schematically illustrating an example of inrush currents which can occur while the display device of the present disclosure is driven.

FIG. 6A is a graph schematically illustrating an example of inrush currents which can occur while a related art display device is driven (electric current vs time (e.g., microseconds)), and FIG. 6B is a graph schematically illustrating an example of inrush currents which may occur while the display device of the present disclosure is driven.

As shown in FIG. 6A, it can be seen that inrush currents which instantaneously occur in the initial stage of driving due to operation currents input to the data modulator at the same time become 2.5 A in the related art display device.

On the other hand, as shown in FIG. 6B, in the display device according to an example of the present disclosure (e.g., the display devices shown in FIGS. 1-5), since the plurality of switching elements SWn of FIG. 4 connected in parallel are sequentially turned on such that currents input to the current controller 155 of FIG. 3A and FIG. 3B are sequentially dispersed in the initial stage of driving, inrush currents which occur in the initial stage of driving can be significantly reduced to, e.g., 1.7 A or even less.

As described above, the display device 100 of FIG. 1 according to the embodiment of the present disclosure can significantly reduce inrush currents by the current controller 155 of FIG. 3A and FIG. 3B of the data modulator 150 of FIG. 2 such that EMI noise can be effectively reduced simultaneously while preventing an element from being damaged by inrush currents so as to improve stability of the display device 100.

According to the embodiment of the present disclosure, a plurality of switching elements of a current controller are sequentially turned on so as to reduce inrush currents such that electromagnetic interference noise can be effectively reduced.

Although an exemplary embodiment of the present disclosure has been described above, it should be understood by one of ordinary skill in the art that a variety of modifications and a variety of changes can be made without departing from the technical concept and scope of the present disclosure which are defined in the following claims.

A number of examples have been described above. Nevertheless, it will be understood that various modifications can be made. For example, suitable results can be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A display device comprising:

a data modulator configured to generate image data from an image signal provided from an outside element;

a data driver configured to generate and output a data signal according to the image data; and a display panel configured to display an image by using the data signal, wherein the data modulator comprises a current controller including a plurality of switching elements connected in parallel, and a current sensor for detecting an output current of the current controller, generating a current control signal corresponding to the detected output current, and supplying the current control signal to the current controller.

2. The display device of claim 1, wherein when currents are applied, the plurality of switching elements are sequentially turned on and reduce inrush currents.

3. The display device of claim 1, wherein the current controller further comprises a switching controller which receives the current control signal and controls the plurality of switching elements.

4. The display device of claim 3, wherein the data modulator further comprises an algorithm processor which receives the output current from the current controller.

5. The display device of claim 1, wherein the image data are red, green, blue and white data obtained by modulating the image signal.

6. The display device of claim 1, wherein the plurality of switching elements are respectively disposed at a plurality of lines, and the plurality of lines converge at an end point thereof.

7. The display device of claim 6, wherein currents input to the current controller are sequentially dispersed into a plurality of lines, and the currents are integrated at an end thereof.

8. A method of driving a display device including a data modulator and a data driver, the method comprising:

generating image data from an image signal provided from an outside element, by using the data modulator including a current controller and a current sensor;

detecting an output current of the current controller;

generating a current control signal corresponding to the detected output current; and supplying the current control signal to the current controller by using the current sensor.

9. The method of claim 8,
further comprising:
reducing inrush currents by sequentially turning on a plurality of switching elements of the current controller.

10. The method of claim 8, wherein the current controller further comprises a switching controller which receives the current control signal and controls a plurality of switching elements of the current controller.

11. The method of claim 10, wherein the data modulator further comprises an algorithm processor which receives the output current from the current controller.

12. The method of claim 8, wherein the image data are red, green, blue and white data obtained by modulating the image signal.

* * * * *